US009790693B2

(12) United States Patent
Wilde

(10) Patent No.: US 9,790,693 B2
(45) Date of Patent: Oct. 17, 2017

(54) SCREED GUIDE DRAIN ADAPTOR

(71) Applicant: Bart Allen Wilde, Heber City, UT (US)

(72) Inventor: Bart Allen Wilde, Heber City, UT (US)

( * ) Notice: Subject to any disclaimer, the term of this patent is extended or adjusted under 35 U.S.C. 154(b) by 0 days.

(21) Appl. No.: 14/954,353

(22) Filed: Nov. 30, 2015

(65) Prior Publication Data

US 2017/0152667 A1 Jun. 1, 2017

(51) Int. Cl.

| | |
|---|---|
| ***A47K 7/02*** | (2006.01) |
| ***E04F 21/24*** | (2006.01) |
| ***E03F 5/04*** | (2006.01) |
| *E03F 5/06* | (2006.01) |

(52) U.S. Cl.

CPC ..... *E04F 21/24* (2013.01); *E03F 5/0408* (2013.01); *E03F 5/0409* (2013.01); *E03F 5/06* (2013.01)

(58) Field of Classification Search

CPC ..... A47K 3/40
USPC ..... 4/596–614
See application file for complete search history.

(56) References Cited

U.S. PATENT DOCUMENTS 4,978,250 A * 12/1990 Dallmer ..... E03F 5/0407 137/362
5,299,836 A * 4/1994 Woods ..... E03F 5/0407 210/165
6,319,397 B1 * 11/2001 Su ..... E03C 1/20 210/163
6,799,606 B1 * 10/2004 Howson ..... E04D 13/0409 138/89
7,472,719 B2 * 1/2009 Dallmer ..... E03F 5/0408 137/362
7,562,495 B1 * 7/2009 Fairchild ..... A47K 3/40 4/613
8,677,521 B2 * 3/2014 Stimpson ..... A47K 3/40 4/613
2013/0174921 A1 * 7/2013 Schluter ..... E03F 3/04 137/362
2014/0352810 A1 * 12/2014 Wedi ..... E03F 5/04 137/362

FOREIGN PATENT DOCUMENTS

| | | | |
|---|---|---|---|
| AU | 2003242498 | A1 | 3/2004 |
| DE | 102005038315 | A1 | 2/2007 |
| EP | 2712682 | A1 | 4/2014 |
| GB | 2374876 | A | 10/2002 |

* cited by examiner

*Primary Examiner* — Lori Baker
(74) *Attorney, Agent, or Firm* — Fabian VanCott; Brian J. Riddle

(57) ABSTRACT

A screed guide drain adaptor includes a circular disk with a recessed circular center portion defined therein. The recessed circular center portion creates a transition between an outer ring portion and the recessed circular center portion. The screed guide drain adaptor includes a drain aperture defined within the recessed circular center portion. The screed guide is made of a rigid material.

17 Claims, 10 Drawing Sheets

SCREED GUIDE DRAIN ADAPTOR

BACKGROUND

Plumbing is a system of pipes, drains, fittings, valves, and fixtures installed for the distribution of potable water for drinking, heating and washing, and waterborne waste removal. Plumbing originated during ancient civilizations such as the Greek, Roman, Persian, Indian, and Chinese civilizations as the needed to provide potable water and wastewater removal for larger numbers of people grew. In particular, the need to drain waste water such as greywater or sullage has become ubiquitous in civilized countries around the world. Greywater or sullage is all wastewater generated in households or commercial buildings that does not contain fecal contamination, and may have sources such as sinks, showers, baths, clothes washing machines and dish washers.

BRIEF DESCRIPTION OF THE DRAWINGS

The accompanying drawings illustrate various examples of the principles described herein and are a part of the specification. The illustrated examples are given merely for illustration, and do not limit the scope of the claims.

Throughout the drawings, identical reference numbers designate similar, but not necessarily identical, elements.

DETAILED DESCRIPTION

Figure 1:
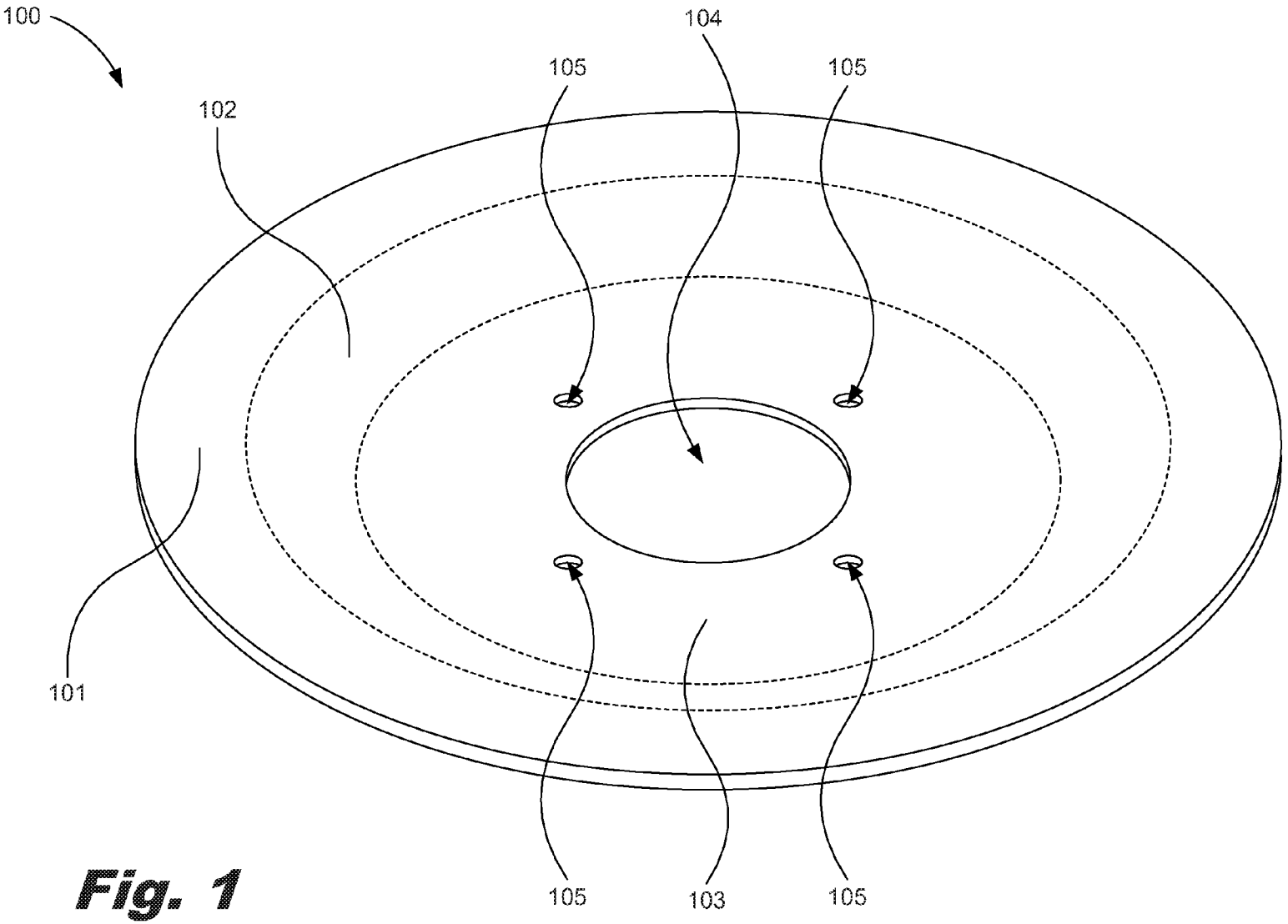
FIG. 1 is an isometric view of a screed guide drain adaptor, according to one example of the principles described herein.

In installing greywater drain systems, an extensive process is implemented to ensure that fluids such as water and greywater are drained out of the structure such as a home or commercial building without allowing the water and greywater to penetrate to other areas of the structure. Greywater drain systems are therefore used in internal areas, such as for example in showers and bathrooms. If water or greywater were allowed to penetrate, for example, surrounding areas of a shower, such penetration would cause significant fluid damage to adjacent building materials within the structure, and may require significant costs in repair. Further, many greywater drain systems have a complex and expensive structure with many individual parts, which can lead to unnecessarily high costs in manufacturing an installation.

In installing a shower drain, for example, the installer may first apply a mortar bed bond coat or a cleavage membrane to a substrate such as a concrete floor. A sloped mortar bed may then be poured to create a sloped surface that allows fluid to run toward a drain system located at the low point of the sloped surface. This mortar pour is a first pour of at least two separate mortar pours. A waterproof membrane may then be applied to the first mortar pour to ensure fluid does not penetrate into the first mortar pour. The waterproof membrane is angled or sloped at ¼ inch per foot as defined by the uniform plumbing code (UPC) to meet the top of a drain base. The installer screeds the sloped mortar bed to meet a lip of a drain base installed within the shower drain area. The shower drain area then slopes upward from the drain at ¼ inch per foot towards the perimeter walls and/or curb of the shower. Screeding, however, is an extra process that creates a pre-slope and expends extra time, effort, and resources in completing a shower drain system using this method.

A clamping ring is attached to the drain base, and a pea gravel or other weep protection is accumulated along a top side of the clamping ring and above the portions of the waterproof membrane next to the clamping ring. An adjustable drain barrel is threadingly coupled to the clamping ring, and a second mortar pour is then applied on top of the pea gravel, clamping ring, and waterproof membrane. In some examples, the waterproof membrane may be placed on top of the final dry pack mortar bed so as to eliminate moisture build-up and introduction of foreign contaminates that may lead to the production of unwanted mold and mildew. The inability of a user to properly screed the mortar pours has made it difficult to install a shower floor with a properly poured floor and increases costs in both materials and time in paying the installer of the shower floor.

Examples described herein provide a system for screeding a drain pour. The system includes a screed guide attachable to a drain base. The screed guide includes a circular disk with a recessed circular center portion defined therein, a drain aperture defined within the recessed circular center portion, and a number of screed guide coupling apertures defined in the recessed circular center portion. The screed guide is made of a rigid material.

The circular disk with the recessed circular center portion includes a transition ring angled with respect to an outer ring and the recessed circular center portion and coupling the outer ring to the recessed circular center portion. The outer ring comprises a first slope relative to a horizontal line that enables drainage of fluid across the first slope. The angle of the transition ring with respect to the outer ring and the recessed circular center portion is at least greater than the first slope of the outer ring.

In one example, the recessed circular center portion comprises a second slope relative to a horizontal line that enables drainage of the fluid across the second slope. Further, in one example, the coupling apertures match a number of apertures defined in the drain base. The drain aperture comprises a diameter equal to the diameter of a drain base aperture defined in the drain base.

The system may include a clamping ring to couple the screed guide to the drain base. The clamping ring includes a number of clamping ring apertures defined in the clamping ring through which a number of fasteners are extended to couple the clamping ring to the drain base via the screed guide coupling apertures of the recessed circular center portion of the screed guide.

In one example, the screed guide is made of a oxidation-proof metal. In one example, the screed guide is made of acrylonitrile butadiene styrene (ABS).

Further, examples described herein provide a screed guide drain adaptor. The screed guide drain adaptor includes a circular disk with a recessed circular center portion defined therein. The recessed circular center portion creates a transition between an outer ring portion and the recessed circular center portion. The screed guide drain adaptor may also include a drain aperture defined within the recessed circular center portion, wherein the screed guide is made of a rigid material. A number of screed guide coupling apertures may be defined in the recessed circular center portion. A number of fasteners extend through the screed guide coupling apertures to couple a clamping ring to a drain base via the screed guide coupling apertures.

The transition of the screed guide coupling apertures is angled with respect to the outer ring and the recessed circular center portion and couples the outer ring to the recessed circular center portion. Further, the outer ring includes a first slope relative to a horizontal line that enables drainage of fluid across the first slope. The recessed circular center portion includes a second slope relative to a horizontal line that enables drainage of the fluid across the second slope.

Still further, examples described herein provide a kit for screeding a drain pour. The kit may include a drain base to couple a drain to a clamping ring, and a screed guide to couple to the drain base between the drain base and the clamping ring. The screed guide includes a circular disk with a recessed circular center portion defined therein. The recessed circular center portion creates a transition ring between an outer ring and the recessed circular center portion. Further, the screed guide is made of a rigid material.

The kit may further include the clamping ring. The clamping ring includes a threaded aperture defined within a center of the clamping ring. Further, an adjustable drain barrel may be included in the kit. The adjustable drain barrel includes a threading formed on an exterior barrel portion of the drain barrel that mates with the threaded aperture of the clamping ring.

The transition ring of the screed guide is angled with respect to the outer ring and the recessed circular center portion and couples the outer ring to the recessed circular center portion. The outer ring includes a first slope relative to a horizontal line that enables drainage of fluid across the first slope. The recessed circular center portion includes a second slope relative to a horizontal line that enables drainage of the fluid across the second slope.

As used in the present specification and in the appended claims, the term "a number of" or similar language is meant to be understood broadly as any positive number comprising 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described in connection with that example is included as described, but may not be included in other examples.

Turning now to the figures, FIG. 1 is an isometric view of a screed guide drain adaptor (100), according to one example of the principles described herein. The screed guide drain adaptor (100) is used as a drain adaptor within a greywater drain system such as a shower drain. Further, the screed guide drain adaptor (100) is also used as a screed guide to be used during a pouring of mortar within the greywater drain system. Thus, the screed guide drain adaptor (100) serves at least a dual purpose, reduces the amount of elements within a greywater drain system, simplifies the greywater drain system, and simplifies the installation of the greywater drain system.

The screed guide (100) described herein may be made of any material that is impermeable to fluids such as greywater. In one example, the screed guide (100) is made of an oxidation-proof material. In one example, the screed guide (100) may be made of terracotta, acrylonitrile butadiene styrene (ABS), polyvinyl chloride (PVC), unplasticized polyvinyl chloride (UPVC), post chlorinated polyvinyl chloride (CPVC), polybutylene (PB-1), polypropylene (PP), polyethylene (PE), low-density polyethylene (LDPE), high-density polyethylene (HDPE), polyvinylidene fluoride (PVDF), metals, metal alloys, metals, non-oxidizing metal alloys, stainless steel, non-combustible metals, non-combustible metal alloys, other materials used in plumbing, and combinations thereof.

Figure 2:
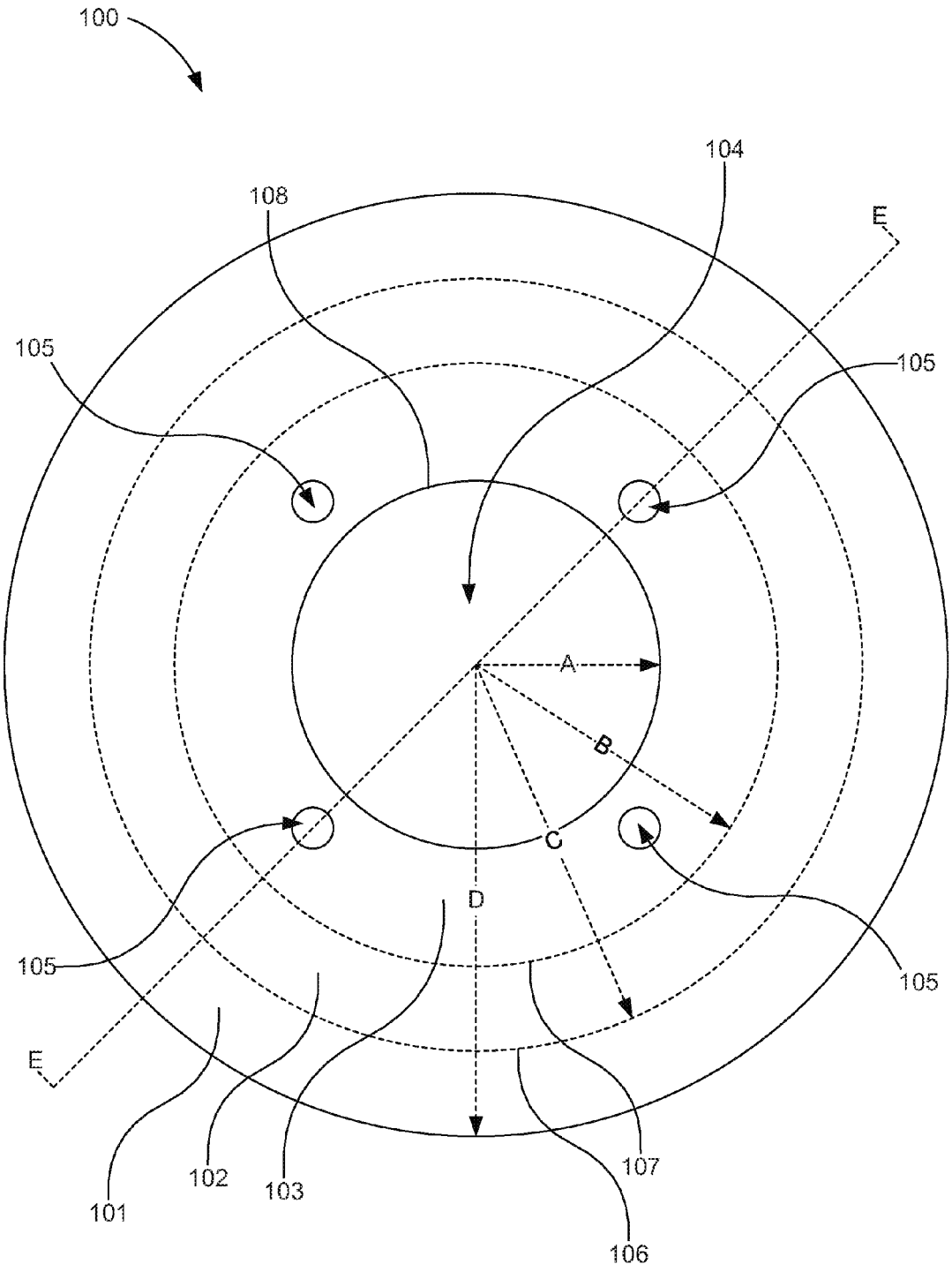
FIG. 2 is a top view of the screed guide drain adaptor of FIG. 1, according to one example of the principles described herein.

FIG. 2 is a top view of the screed guide drain adaptor (100) of FIG. 1, according to one example of the principles described herein. The various dimensions of the screed guide drain adaptor (100) will now be described. In one example, the screed guide drain adaptor (100) may have an overall radius (D) that is approximately between 4 and 12 inches. In another example, the overall radius (D) of the screed guide drain adaptor (100) may be approximately between 5 and 10 inches. In still another example, the overall radius (D) of the screed guide drain adaptor (100) may be approximately 6⅝ inches.

A line indicating the boundary between the outer ring (101) and the transition ring (102) is indicated by 106. The distance from the center of the screed guide drain adaptor (100) to line 106 as indicated by line C may be between approximately 4 and 12 inches. In another example, the distance from the center of the screed guide drain adaptor (100) to line 106 as indicated by line C may be approximately between 4 and 9 inches. In still another example, the distance from the center of the screed guide drain adaptor (100) to line 106 as indicated by line C may be approximately ⅜ inches. In other words, the radius of the screed guide drain adaptor (100) at line 106 may be approximately 5⅜ inches.

Line 107 indicates the boundary between the transition ring (102) and the recessed circular center portion (103) defined in the screed guide drain adaptor (100). The distance from the center of the screed guide drain adaptor (100) to line 107 as indicated by line B may be between approximately 4 and 12 inches. In another example, the distance from the center of the screed guide drain adaptor (100) to line 106 as indicated by line B may be approximately between 3 and 8 inches. In still another example, the distance from the center of the screed guide drain adaptor (100) to line 106 as indicated by line B may be approximately 5½ inches. In other words, the radius of the screed guide drain adaptor (100) at line 106 may be approximately 5½ inches.

Line 108 indicates the distance from the center of the screed guide drain adaptor (100) to the inner radius of the drain aperture (104) defined in the center of the screed guide drain adaptor (100). The drain aperture (104) is defined in the screed guide drain adaptor (100) in order to match or approximately match the diameter of a drain pipe and/or an aperture defined in a drain base. In this manner, the screed guide drain adaptor (100) is able to allow fluid to drain through the drain aperture (104), into the drain base, and down the remainder of the greywater drain system. Thus, the radius of the drain aperture (104) or, in other words, the distance of line A may be between more than zero inches and 6 inches. In another example, the distance of line A may be between 2 and 5 inches. In still another example, the distance of line A may be approximately 3⅛ inches.

A number of screed guide coupling apertures (105) may be defined in the screed guide drain adaptor (100). The coupling apertures (105) may be used to couple the screed guide drain adaptor (100) to a drain base via a number of collar bolts used to couple a clamping ring to the drain base as will be described in more detail below.

Figure 3:
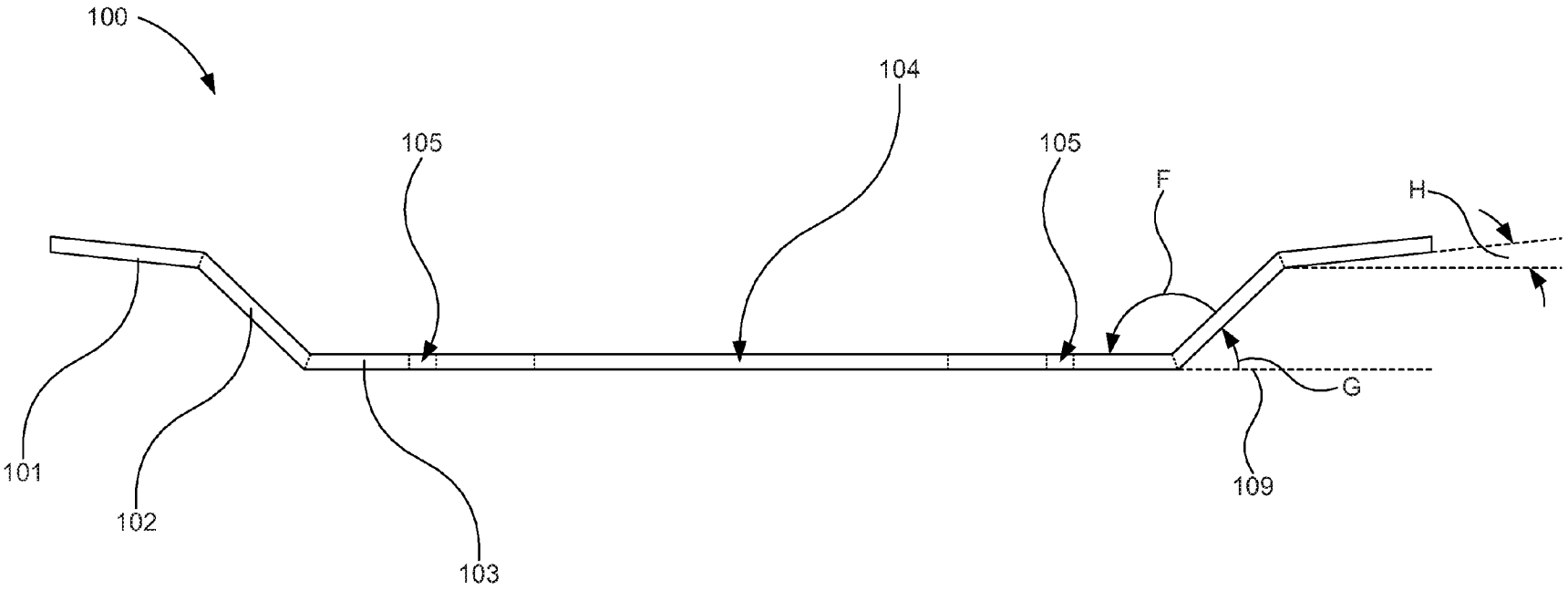
FIG. 3 is a side view of the screed guide drain adaptor of FIG. 1 along line E of FIG. 2, according to one example of the principles described herein.

The screed guide drain adaptor (100) includes a circular-shaped disk with a recessed circular center portion (103) defined therein as described above. Because of the recessed circular center portion (103), an outer ring (101) or flange, and a transition ring (102) is created in the screed guide drain adaptor (100). FIG. 3 is a side view of the screed guide drain adaptor (100) of FIG. 1 along line E of FIG. 2, according to one example of the principles described herein. As depicted in FIG. 3, the outer ring (101), transition ring (102), and recessed circular center portion (103) of the screed guide drain adaptor (100) may be angled with respect to one another in order to allow fluids to drain down the surfaces of the screed guide drain adaptor (100) and weep into the drain base, for example.

In one example, angles F and G define an angle of the transition ring (102) with respect to the recessed circular center portion (103) of the screed guide drain adaptor (100). In one example, angle G is between 1° and 90° relative to a baseline (109) making angle F between 89° and 180° relative to the baseline (109). In another example, angle G is between 20° and 70° relative to a baseline (109) making angle F between 110° and 160° relative to the baseline (109). In still another example, angle G is approximately 45° relative to a baseline (109) making angle F approximately 135° relative to the baseline (109).

One purpose of the outer ring (101) is to provide a surface from which mortar or other cement material may be leveled using a screed. A screed is a length of material such as a metal trowel or a level that is dragged across the surface of the mortar in order to obtain a level surface relative to a desired elevation. Thus, the outer ring (101) serves as a screed guide such that an installer of the drain system may prepare a flat, straight, and properly sloped surface of the mortar that rises away from the drain aperture (104) of the screed guide drain adaptor (100) at an angle. Thus, one purpose of the outer ring (101) being angled as defined by angle H is to provide a slope down which fluid may run into the drain system. Thus, in one example, angle H may be between 0° and 50°. In another example, angle H may be between 5° and 20°. In still another example, angle H may be approximately 5°.

In yet another example, angle H may be determined based on an industry standard for sloping used in connection with fluid draining. In this example, to efficiently drain, an industry recommended minimum slope for a shower floor is between approximately 2 and 4 percent, between approximately 1° and 3°, or a ¼ to ½ inch drop per every 12 inches from the shower walls to the drain. One exception to these elevation changes occurs when someone with limited mobility will be using the shower. If this is the case, the shower floor may include a slope no greater than 2 percent, or ¼ inch vertical drop per 12 horizontal inches.

Figure 4:
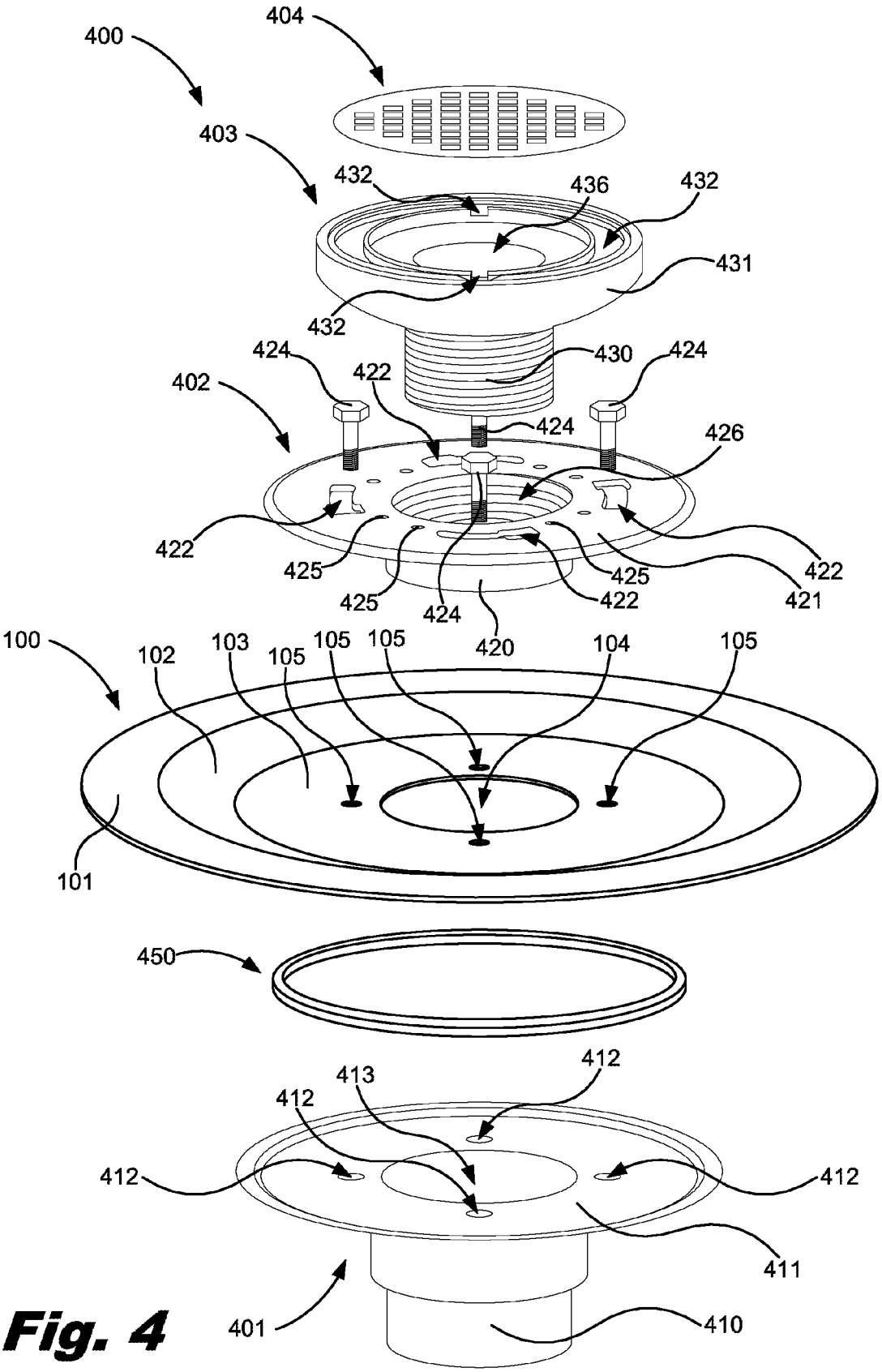
FIG. 4 is an isometric view of the screed guide drain adaptor of FIG. 1 as incorporated into a drain system, according to one example of the principles described herein.

The position within a greywater drain system that the screed guide drain adaptor (100) is placed will now be described in connection with FIG. 4. FIG. 4 is an isometric view of the screed guide drain adaptor (100) of FIG. 1 as incorporated into a drain system (400), according to one example of the principles described herein. A greywater drain system may include a number of elements including a drain base (401), a clamping ring (402), an adjustable drain barrel (403), and a strainer (404). The materials from which the various elements described herein are made of may include terracotta, acrylonitrile butadiene styrene (ABS), polyvinyl chloride (PVC), unplasticized polyvinyl chloride (UPVC), post chlorinated polyvinyl chloride (CPVC), polybutylene (PB-1), polypropylene (PP), polyethylene (PE), low-density polyethylene (LDPE), high-density polyethylene (HDPE), polyvinylidene fluoride (PVDF), metals, metal alloys, metals, non-oxidizing metal alloys, stainless steel, non-combustible metals, non-combustible metal alloys, other materials used in plumbing, and combinations thereof. Thus, the methods and materials used to couple these various elements including the drain base (401), a clamping ring (402), an adjustable drain barrel (403), and a strainer (404) and workpiece elements may include, for example, gluing, interference fitting, chemical solvent welding, metal welding, The drain base (401) is a first fixture used to couple the drain system (400) to a drain pipe that leads to a sewer system located outside the structure in which the drain system (400) is incorporated. The drain pipe is coupled to the drain base (401) using, for example, a solvent cement. In this example, the drain pipe and the drain base (401) are made of a PVC, ABS, or similar material that may be welded using a solvent cement. The drain base (401) may be coupled to the drain pipe during a roughing in of the drain system (400) and prior to the coupling of the clamping ring (402), adjustable drain barrel (403), and strainer (404), before preparing the remainder of the shower, or a combination thereof.

The drain base (401) includes a female coupling neck (410) to couple the drain base (401) to the drain pipe, a coupling interface (411), and a number of drain base apertures (412). Like other elements within the drain system (400), a drain base passage (413) is defined in the center of the drain base (401) to allow for sullage to pass through the drain base (401) and into the drain pipe for disposal into an external sewage system.

The screed guide drain adaptor (100) is coupled between the drain base (401) and the clamping ring (402). The clamping ring (402) includes a coupling neck (420) that creates an interference fit with the drain base passage (413) of the drain base (401). Further, the coupling neck (420) of the clamping ring (402) and the drain aperture (104) defined in the center of the screed guide drain adaptor (100) are dimensioned such that the coupling neck (420) that creates an interference fit with the drain aperture (104) of the screed guide drain adaptor (100). In this manner, the drain aperture (104) defined in the screed guide drain adaptor (100) has a diameter at least as wide as the diameter of the coupling neck (420) of the clamping ring (402).

The clamping ring (402) further includes a coupling interface (421). The coupling interface (421) of the clamping ring (402) includes a number of bolt apertures (422) through which a corresponding number of bolts (424) are inserted. The bolts (424) are inserted into the bolt apertures (422), through the screed guide coupling apertures (105), and threaded into the drain base apertures (412) to couple the clamping ring (402) to the drain base (401) with the screed guide drain adaptor (100) coupled there between.

The clamping ring (402) further includes a number of weep apertures (425) defined in the coupling interface (421) of the clamping ring (402). The weep apertures (425) are included so that if any fluids penetrate any number of layers of mortar or membranes, the fluid may be funneled to the weep apertures (425) and run into the recessed circular center portion (103) of the screed guide drain adaptor (100) and the coupling interface (411) of the drain base (401) and into the drain aperture (104) of the screed guide drain adaptor (100) and the drain base passage (413) of the drain base (401).

The clamping ring (402) further includes a threaded passage (426). The threaded passage (426) of the clamping ring (402) is threaded to accept a correspondingly threaded coupling neck (430) of the adjustable drain barrel (403). In this manner, the adjustable drain barrel (403) may be adjusted up or down to match the height of a top layer of a shower into which the drain system (400) is installed. The adjustable drain barrel (403) includes a number of drain grooves (432) defined in a funnel portion (431) of the adjustable drain barrel (403). The drain grooves (432) allow for fluids to enter through the strainer (404), and either flow into a drain barrel passage (436), or into the drain grooves (432) and into the drain barrel passage (436).

As depicted in FIG. 4, the drain system (400) allows for the screed guide drain adaptor (100) to protrude outwardly with respect to the remainder of the elements within the system (400). This allows an installer of the drain system (400) to use the outer ring (101) of the screed guide drain adaptor (100) to assist him or her in leveling and sloping a number of mortar pours. The installer is able to place a screed on the screed guide drain adaptor (100), and use the angle of the outer ring (101) as a guide in making the appropriate slope for the mortar pour and to ensure that the pour is level with respect to that slope.

In one example, a seal (450) may be included between the screed guide drain adaptor (100) and the drain base (401). The seal (450) may be any device or material that seals the space between the screed guide drain adaptor (100) and the drain base (401). The seal (450) ensures that fluids running down the top surface of the screed guide drain adaptor (100) into the drain base (401) do not seep past the space between the screed guide drain adaptor (100) and the drain base (401) and into other layers of the shower system such as a mortar pour. In one example, the seal (450) is a gasket. In another example, the seal (450) may be a silicone resin, a silicone grease, a wax, a caulk, or other sealant.

Figure 5:
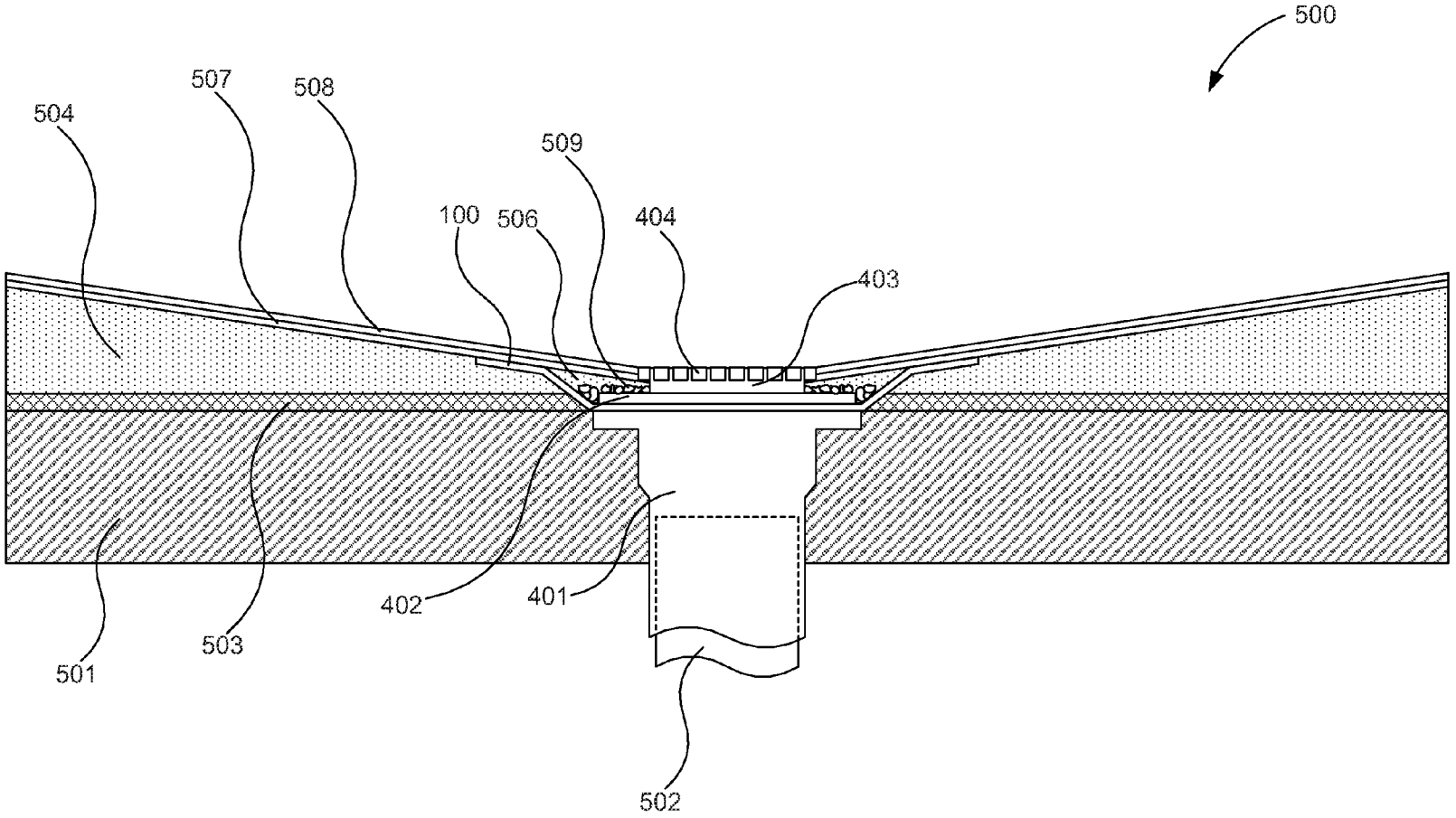
FIG. 5 is a side view of the screed guide drain adaptor of FIG. 1 as incorporated into an installed drain system, according to one example of the principles described herein.

The method of installation of the drain system (400) and use of the screed guide drain adaptor (100) to guide an installer will now be described in connection with FIG. 5. FIG. 5 is a side view of the screed guide drain adaptor of FIG. 1 as incorporated into an installed drain system, according to one example of the principles described herein. Slopes of surfaces depicted in FIG. 5 are exaggerated to show the existence of the slopes.

The drain system (400) of FIG. 5 is installed in, for example, a shower base (500). Before a drain system (400) is installed, a base surface (501) is created during the construction of the building or structure. This base surface (501) may be made of, for example, concrete poured during the pouring of the foundation of the structure. In this example, the rough plumbing was completed, and a drain pipe (502) was embedded within the base surface (501). The installer of the drain system (400) couples the drain base (401) to the drain pipe (502) using, for example, a solvent cement.

A mortar bed bond coat, waterproof membrane, or other primary sealing layer (503) may be applied to the base surface (501) to ensure that fluids that may seep past the various other layers within the shower base (500) do not penetrate to or into the base surface (501). In another example, the primary sealing layer (503) is not included within the shower. In this example, a pre-sloped fill is provided under the other elements depicted in FIG. 5. This pre-sloped fill ensures that any fluids that penetrate layers or elements above the pre-sloped fill will drain to weep holes within the drain base (401). In an example of the use of a pre-sloped fill, a shower pan membrane may be applied to the top surface of the pre-sloped fill.

The screed guide drain adaptor (100) is coupled to the drain base (401) between the clamping ring (402) and the drain base (401). As described above, the bolts (FIG. 4, 424) are inserted into the bolt apertures (FIG. 4, 422), through the screed guide coupling apertures (FIG. 1, 105), and threaded into the drain base apertures (FIG. 4, 412) to couple the clamping ring (402) to the drain base (401) with the screed guide drain adaptor (100) coupled there between.

A layer of mortar (504) is poured around the drain base (401), the clamping ring (402) and the screed guide (100) of the drain system (100). During this first pour, the screed guide (100) is used by the installer to obtain a flat, straight, and properly sloped mortar pour. As described above, the outer ring (FIG. 3, 101) of the screed guide (100) is angled as defined by angle H in order to provide a slope down which fluid may run into the drain system (400). Thus, the installer uses the outer ring (FIG. 3, 101) of the screed guide (100) as a guide from which he or she trowels and screeds the first layer of mortar (504) in order to ensure that the first layer of mortar (504) is appropriately flat and straight, and has a slope defined by angle H of the outer wing (FIG. 3, 101) of the screed guide (100).

In the example of FIG. 5, the layer of mortar (504) is poured to slope with the outer ring (FIG. 3, 101) of the screed guide (100) at angle H under and to the side of the screed guide (100). Further, mortar is poured above and within the circumference of the screed guide (100) as indicated by 506. In this manner, a single mortar pour is applied to an entirety of the surface apart from the top of the outer ring (FIG. 3, 101) of the screed guide (100). The installer uses the outer ring (FIG. 3, 101) of the screed guide (100) to make the mortar (504) slope both interior to and exterior to the outer ring (FIG. 3, 101) up to the drain barrel (403) by using the outer ring (FIG. 3, 101) as a guide during his or her trowel and screed process. Further, in one example, an amount of pee gravel or other weep protection material (509) may be placed in the lower level of the screed guide (100) over the number of weep apertures (425) defined in the coupling interface (421) of the clamping ring (402), while still leaving sufficient room for the mortar (504) to fill the space above the screed guide (100) and clamping ring (402). In this manner, fluids that may penetrate to that point in the shower base (500) weep into the drain system (400).

The above process greatly simplifies the installation of a shower drain system. An installer may otherwise have to use visual inspection to determine if a mortar pour is appropriately level and has a sufficient slope. With the use of the screed guide (100), the installer may quickly and easily screed the layer of mortar (504) saving time and costs in installing the drain system (400).

A layer of bond coat (507) is applied to the layer of mortar (504). The layer of waterproofing material (505) ensures that any fluids that seep to that point are redirected into the drain system (400) instead of seeping further into underlying layers of material. In this manner, fluids may run down the slope created by the screed guide (100) along the top surface of the layer of waterproofing material (505), and into the weep apertures (FIG. 4, 425) defined in the coupling interface (FIG. 4, 421) of the clamping ring (402). In one example, the layer of waterproofing material (505) is a layer of hydrophobic sealant, in the form of a liquid sealant or sheet membrane material that may be, for example, painted or applied onto the top surface of the layer of mortar (504). In this example, the layer of waterproofing material (505) may be applied to a top surface of the outer ring (FIG. 1, 101) of the screed guide drain adaptor (100) in order to ensure that the layer of waterproofing material (505) overlaps the screed guide drain adaptor (100). This, in turn, ensures that fluids cannot bypass the layer of waterproofing material (505) and seep into layers of material below.

The drain barrel (403) is threaded into the clamping ring (402). Tiles, cultured marble or other finishing material (508) is applied to the layer of waterproofing material (505) to the level of the strainer (404) such that the top of the strainer (404) and the finishing material (508) are approximately the same elevation and to ensure that fluid does not pool between the strainer (404) and the finishing material (508). In one example, the drain barrel (403) may be threaded further into or further out of the clamping ring (402) so that the strainer (404) is made level with the finishing material (508).

The example of FIG. 5 eliminates at least one pour of mortar in comparison to other systems and methods including that one described below in FIG. 6. Not requiring additional mortar pours greatly simplifies the drain system installation. In one example, a dry pack mortar pour may be applied on top of the weep protection material (509) within the interior portion of the screed guide (100). This allows for the installer to immediately finish the shower drain installation rather than waiting for a number of days after the layer of waterproofing material (505) such as a membrane material is applied to complete the installation. This further results in a decrease in costs in connection with materials such as mortar and waterproofing material as well as a decrease in costs associated with work performed by the plumbing professional. Further, this also decreases the time taken in installing the drain and shower system.

Figure 6:
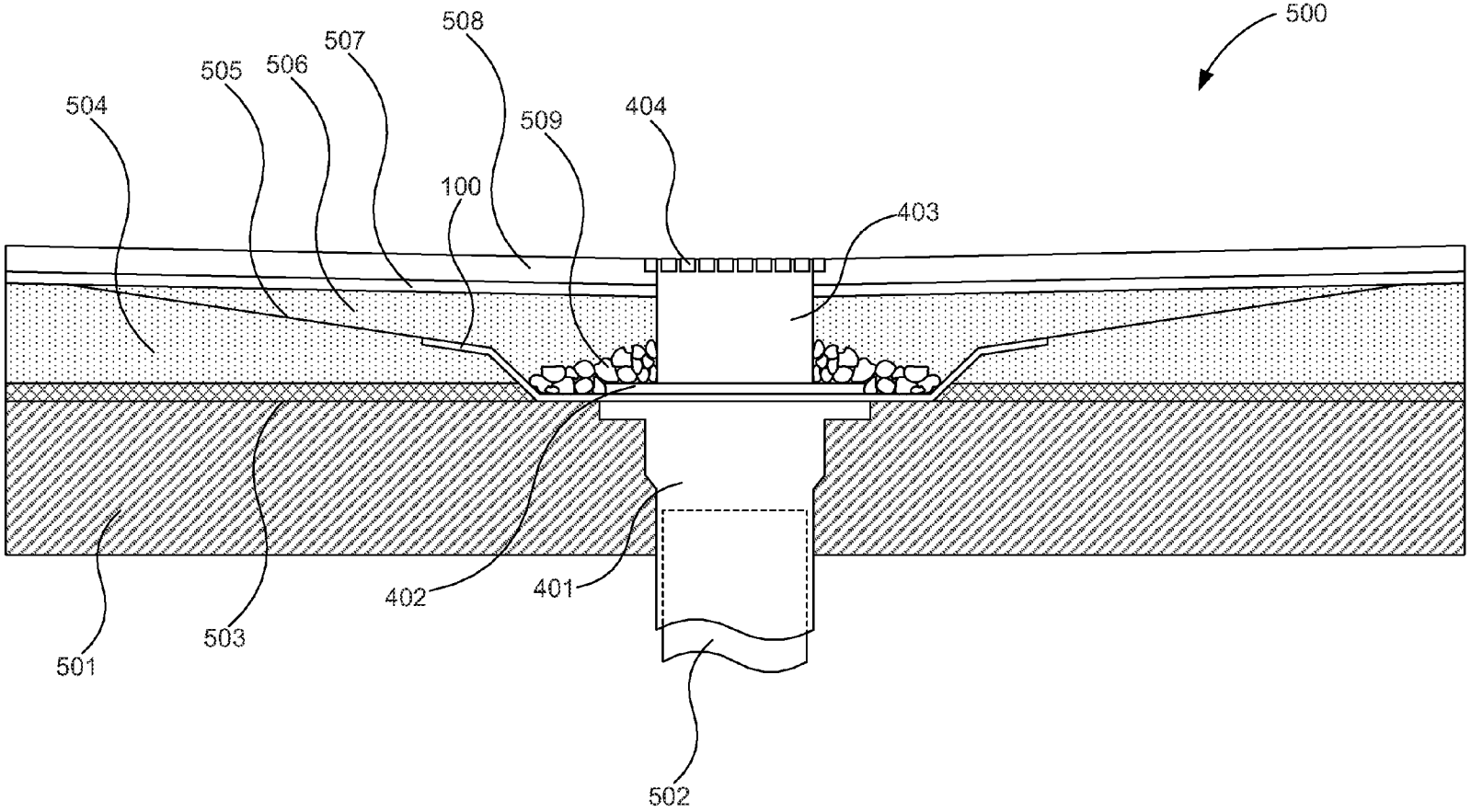
FIG. 6 is a side view of the screed guide drain adaptor of FIG. 1 as incorporated into an installed drain system, according to another example of the principles described herein.

FIG. 6 is a side view of the screed guide drain adaptor (100) of FIG. 1 as incorporated into an installed drain system (400), according to another example of the principles described herein. Although at least one mortar pour may be eliminated by utilizing the screed guide drain adaptor (100), it is possible to install additional layers of material other than those described in connection with FIG. 5. A similar description as compared to FIG. 5 will now be provided. Further, examples of the embodiment of FIG. 6 may be found in the 2015 *TCNA Handbook for Ceramic, Glass, and Stone Tile Installation* published by the Tile Council of north America, Inc. at pages 230-241 regarding industry standards B414-15, B441-15, B415-15, B420-15, B426-15, and B431-15.

The drain system (400) of FIG. 6, for example, may include additional layers of material. The drain system (400) if FIG. 6 is installed in, for example, a shower base (500). Before a drain system (400) is installed, a base surface (501) is created during the construction of the building or structure. This base surface (501) may be made of, for example, concrete poured during the pouring of the foundation of the structure. In this example, the rough plumbing was completed, and a drain pipe (502) was embedded within the base surface (501). The installer of the drain system (400) couples the drain base (401) to the drain pipe (502) using, for example, a solvent cement. A mortar bed bond coat, waterproof membrane, or other primary sealing layer (503) is applied to the base surface (501) to ensure that fluids that may seep past the various other layers within the shower base (500) do not penetrate to or into the base surface (501).

The screed guide drain adaptor (100) is coupled to the drain base (401) between the clamping ring (402) and the drain base (401). As described above, the bolts (FIG. 4, 424) are inserted into the bolt apertures (FIG. 4, 422), through the screed guide coupling apertures (FIG. 1, 105), and threaded into the drain base apertures (FIG. 4, 412) to couple the clamping ring (402) to the drain base (401) with the screed guide drain adaptor (100) coupled there between.

A first layer of mortar (504) is poured around the drain base (401), the clamping ring (402) and the screed guide (100) of the drain system (100). During this first pour, the screed guide (100) is used by the installer to obtain a level and properly sloped mortar pour. As described above, the of the outer ring (FIG. 3, 101) of the screed guide (100) is angled as defined by angle H in order to provide a slope down which fluid may run into the drain system (400). Thus, the installer uses the outer ring (FIG. 3, 101) of the screed guide (100) as a guide from which he or she trowels or screeds the first layer of mortar (504) in order to ensure that the first layer of mortar (504) is appropriately level and has a slope defined by angle H of the outer wing (FIG. 3, 101) of the screed guide (100). This greatly simplifies the installation process. An installer may otherwise have to use visual inspection to determine if a mortar pour is appropriately flat and straight, and has a sufficient slope. With the use of the screed guide (100), the installer may quickly and easily screed the first layer of mortar (504) saving time and costs in installing the drain system (400).

A layer of waterproofing material (505) is applied to the first layer of mortar (504). The layer of waterproofing material (505), like other layers within the shower base (500) ensures that any fluids that seep to that point are redirected into the drain system (400) instead of seeping further into underlying layers of material. In this manner, fluids may run down the slope created by the screed guide (100) along the top surface of the layer of waterproofing material (505), and into the weep apertures (FIG. 4, 425) defined in the coupling interface (FIG. 4, 421) of the clamping ring (402). In one example, the layer of waterproofing material (505) is a layer of hydrophobic sealant that may be, for example, painted onto the top surface of the first layer of mortar (504). In this example, the layer of waterproofing material (505) may be applied to a top surface of the outer ring (FIG. 1, 101) of the screed guide drain adaptor (100) in order to ensure that the layer of waterproofing material (505) overlaps the screed guide drain adaptor (100). This, in turn, ensures that fluids cannot bypass the layer of waterproofing material (505) and seep into layers of material below.

The drain barrel (403) is threaded into the clamping ring (402). In one example, an amount of pee gravel or other weep protection material (509) may be placed above the screed guide (100) and clamping ring (402) to allow for fluids that may penetrate to that point in the shower base (500) to weep into the drain system (400).

In the example of FIG. 6, a second layer of mortar (506) is poured on top of the layer of waterproofing material (505), the screed guide (100), weep protection material (509), and clamping ring (402). The second layer of mortar (506) is poured with a slope to the drain barrel (403) so that other layers disposed on top of the second layer of mortar (506) also slope to the drain barrel (403) and drain into the drain system (400) via the strainer (404). A bond coat (507) may be disposed on top of the second layer of mortar (506). The bond coat (507) is a material used between the back of the finishing material (508) and the prepared surface of the second layer of mortar (506). Examples of bond coats include Portland cement, dry-set Portland cement mortar, latex Portland cement mortar, organic adhesive and epoxy mortar, grout, or adhesives, among other bond coats.

Tiles, cultured marble or other finishing material (508) is applied to the bond coat (507) to the level of the strainer (404) such that the top of the strainer (404) and the finishing material (508) are approximately level and to ensure that fluid does not pool between the strainer (404) and the finishing material (508). In one example, the drain barrel (403) may be threaded further into or further out of the clamping ring (402) so that the strainer (404) is made level with the finishing material (508).

Figure 7:
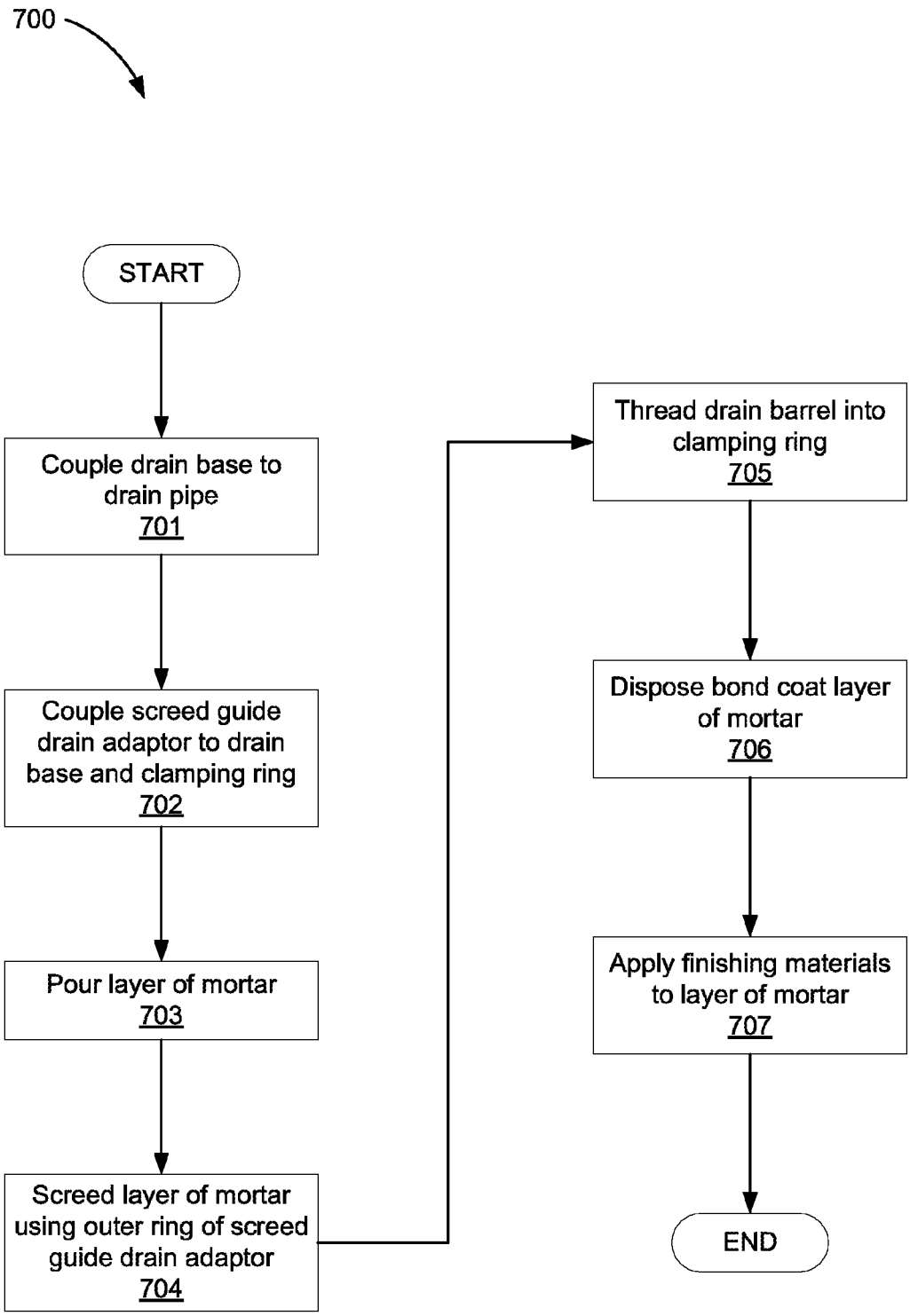
FIG. 7 is a flow chart depicting a method of installing the screed guide drain adaptor of FIG. 1, according to one example of the principles described herein.

FIG. 7 is a flow chart (700) depicting a method of installing the screed guide drain adaptor (100) of FIG. 1, according to one example of the principles described herein. The method may begin by coupling (block 701) the drain base (401) to the drain pipe (502) using, for example, a solvent cement. In one example, a primary sealing layer (503) is applied to a base surface (501) to ensure that fluids that may leach or leak past the various other layers within the shower base (500) do not penetrate to or into the base surface (501).

The screed guide drain adaptor (100) is coupled (block 702) to the drain base (401) between the clamping ring (402) and the drain base (401). In one example, a seal (450) may be included between the screed guide drain adaptor (100) and the drain base (401) to ensure that fluids running down the top surface of the screed guide drain adaptor (100) into the drain base (401) do not seep past the space between the screed guide drain adaptor (100) and the drain base (401).

The layer of mortar (504) is poured (block 703) around the drain base (401), the clamping ring (402) and the screed guide (100) of the drain system (100). The installer screeds (block 704) the layer of mortar using the outer ring (FIG. 1, 101) of the screed guide (100) to obtain a level and properly sloped mortar pour. The installer, in one example, screeds mortar to the circumference of the drain barrel (403) over the top of and into the interior of the screed guide (100). The use of the outer ring (FIG. 1, 101) of the screed guide (100) to obtain a level and properly sloped mortar pour greatly simplifies the installation process by allowing the installer to quickly and easily screed the first layer of mortar (504), and also saves time and costs in installing the drain system (400).

In one example, an amount of weep protection material (509) is placed above the screed guide (100) and clamping ring (402) to allow for fluids that may penetrate to that point in the shower base (500) to weep into the drain system (400). The weep protection material (509) is placed above the screed guide (100) and clamping ring (402) before the installer screeds the mortar located over the top of and into the interior of the screed guide (100). Further, a number of additional finish layers may be applied to the top surface of the first layer of mortar (504) or example, a bond coat (507) is disposed (block 706) on top of the layer of mortar (504), and a finishing material (508) is applied (block 707) to the bond coat (507).

Figure 8:
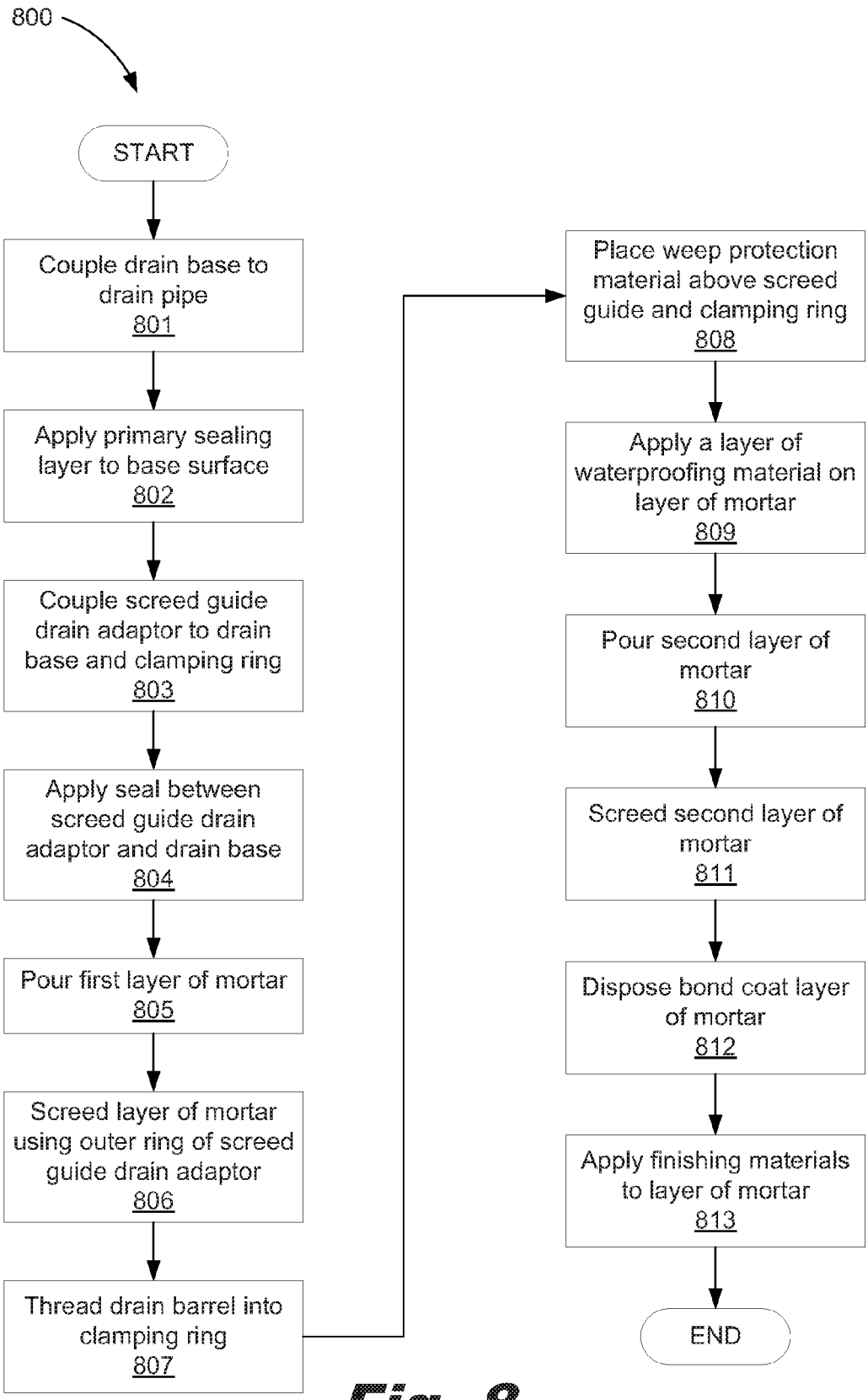
FIG. 8 is a flow chart depicting a method of installing the screed guide drain adaptor of FIG. 1, according to another example of the principles described herein.

FIG. 8 is a flow chart (800) depicting a method of installing the screed guide drain adaptor of FIG. 1, according to another example of the principles described herein. The method of FIG. 8 may begin in a similar manner as described above in connection with the method of FIG. 7 by coupling (block 801) the drain base (401) to the drain pipe (502) using, for example, a solvent cement. The primary sealing layer (503) is applied (block 802) to a base surface (501) to ensure that fluids that may leach or leak past the various other layers within the shower base (500) do not penetrate to or into the base surface (501).

The screed guide drain adaptor (100) is coupled (block 803) to the drain base (401) between the clamping ring (402) and the drain base (401). In one example, a seal (450) may be included (block 804) between the screed guide drain adaptor (100) and the drain base (401) to ensure that fluids running down the top surface of the screed guide drain adaptor (100) into the drain base (401) do not seep past the space between the screed guide drain adaptor (100) and the drain base (401).

A first layer of mortar (504) is poured (block 805) around the screed guide (100) of the drain system (100). The installer screeds (block 806) the layer of mortar using the outer ring (FIG. 1, 101) of the screed guide (100) to obtain a level and properly sloped mortar pour. The use of the outer ring (FIG. 1, 101) of the screed guide (100) to obtain a level and properly sloped mortar pour greatly simplifies the installation process by allowing the installer to quickly and easily screed the first layer of mortar (504), and also saves time and costs in installing the drain system (400).

The drain barrel (403) is threading coupled (block 807) to the clamping ring (402). An amount of weep protection material (509) is placed (block 808) above the screed guide (100) and clamping ring (402) to allow for fluids that may penetrate to that point in the shower base (500) to weep into the drain system (400). The weep protection material (509) is placed above the screed guide (100) and clamping ring (402) before the installer includes additional layers of material above the screed guide 100) and the clamping ring (402).

A layer of waterproofing material (505) is applied (block 809) to the first layer of mortar (504) to ensure that any fluids that seep to that point are redirected into the drain system (400) instead of seeping further into underlying layers of material. A second layer of mortar (506) is poured (block 810) on top of the layer of waterproofing material (505), and screeded (block 811). A number of additional finish layers may be applied to the top surface of the first layer of mortar (504) or example, a bond coat (507) is disposed (block 812) on top of the layer of mortar (504), and a finishing material (508) is applied (block 813) to the bond coat (507).

Figure 9:
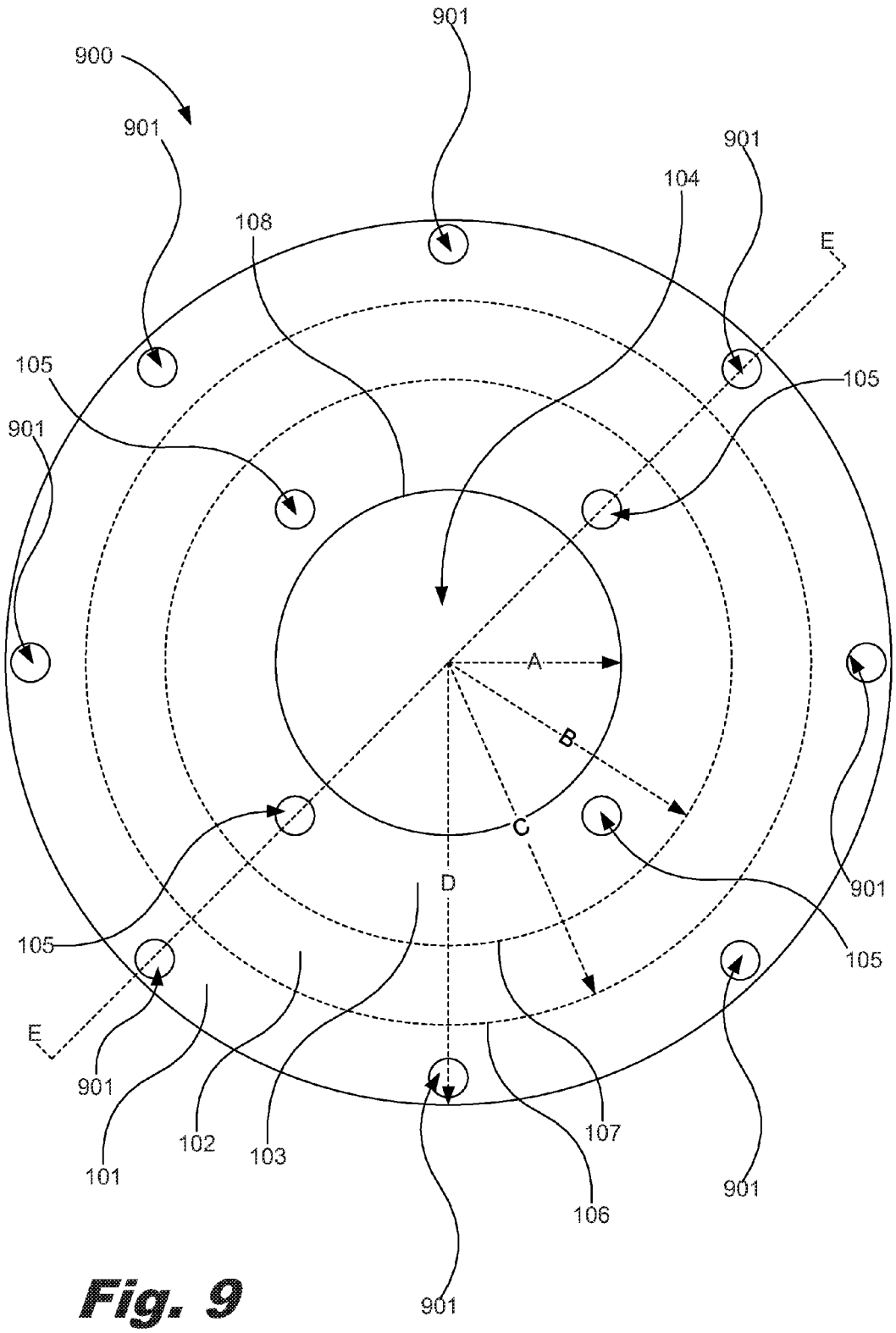
FIG. 9 is a top view of the screed guide drain adaptor, according to another example of the principles described herein.

FIG. 9 is a top view of the screed guide drain adaptor (900), according to another example of the principles described herein. The screed guide drain adaptor (900) is similar to the screed guide drain adaptor (100) described herein. In the example of FIG. 9, however, additional perforations (901) are included in the outer ring (101). The perforations (901) allow for mortar to penetrate into the perforations (901). this penetration of mortar into the perforations (901) of the screed guide drain adaptor (900) ensures that the screed guide drain adaptor (900) does not move from an original set position including rotationally around a center axis of the drain system (400) or vertically with respect to the mortar pour. In this manner, the screed guide drain adaptor (900) is more permanently and securely embedded within the mortar. The perforations (901) may be of any shape including circular as depicted in FIG. 9.

Figure 10:
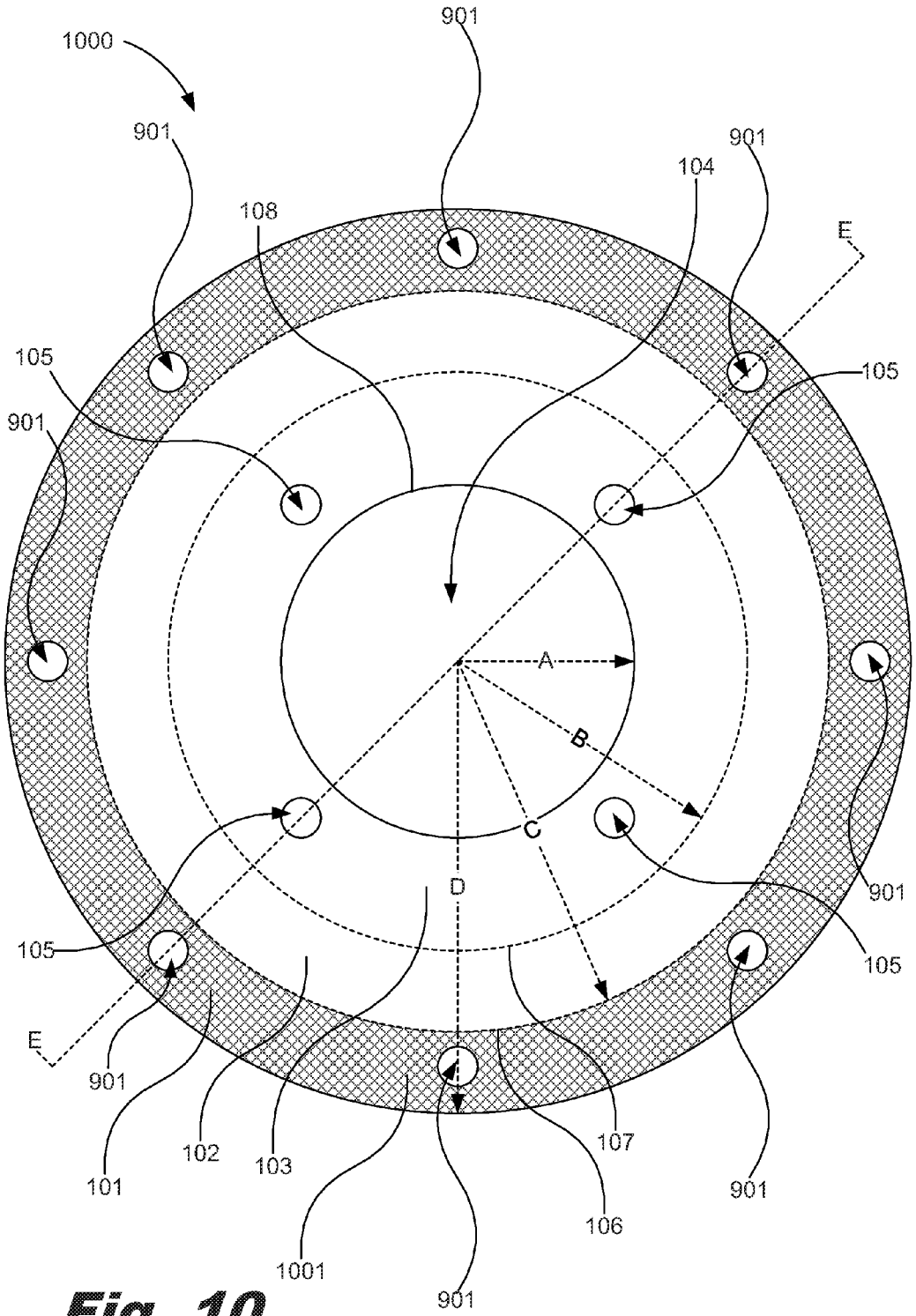
FIG. 10 is a bottom view of the screed guide drain adaptor, according to another example of the principles described herein.

FIG. 10 is a bottom view of the screed guide drain adaptor (1000), according to another example of the principles described herein. The screed guide drain adaptor (1000) is similar to the screed guide drain adaptor (100) described herein. In the example of FIG. 10, however, at least one portion of the bottom of the screed guide drain adaptor (1000) includes a texturing (1001) such as a knurling to assist in gripping between the mortar and the screed guide drain adaptor (1000). Although the texturing (1001) is included on the outer ring (101) of the screed guide drain adaptor (1000), the texturing (1001) may be included on any portion of the screed guide drain adaptor (1000) that comes in contact with mortar.

The various elements described herein may be sold as a kit. The kit may include all or any number of the screed guide (100), the drain base (401), the clamping ring (402), the adjustable drain barrel (403), the strainer (404), or combinations thereof. In one example, the kit includes the screed guide (100).

The specification and figures describe a system for screeding a drain pour. The system includes a screed guide attachable to a drain base. The screed guide includes a circular disk with a recessed circular center portion defined therein, a drain aperture defined within the recessed circular center portion, and a number of screed guide coupling apertures defined in the recessed circular center portion. The screed guide is made of a rigid material. This system for screeding a drain pour may have a number of advantages, including: (1) simplifying installation of a drain system; (2) reducing costs associated with installation of the drain system; and (3) reducing costs in the form of materials used in installing the drain system, among other advantages described herein.

The preceding description has been presented to illustrate and describe examples of the principles described. This description is not intended to be exhaustive or to limit these principles to any precise form disclosed. Many modifications and variations are possible in light of the above teaching.

What is claimed is:

1. A system for screeding a drain pour comprising:

a screed guide attachable to a drain base, the screed guide comprising:

a circular disk with a recessed circular center portion defined therein;

a drain aperture defined within the recessed circular center portion;

a number of screed guide coupling apertures defined in the recessed circular center portion; and further comprising a number of perforations defined in an outer ring of the screed guide, wherein the screed guide is made of a rigid material.

2. The system of claim 1, wherein the circular disk with the recessed circular center portion comprises:

a transition ring angled with respect to an outer ring and the recessed circular center portion and coupling the outer ring to the recessed circular center portion, wherein the outer ring comprises a first slope relative to a horizontal line that enables drainage of fluid across the first slope.

3. The system of claim 2, wherein the first slope of the outer ring is approximately 4%.

4. The system of claim 2, wherein the angle of the transition ring with respect to the outer ring and the recessed circular center portion is at least greater than the first slope of the outer ring.

5. The system of claim 2, wherein the recessed circular center portion comprises a second slope relative to a horizontal line that enables drainage of the fluid across the second slope.

6. The system of claim 1, further comprising a texturing defined in at least a portion of the screed guide.

7. The system of claim 1, further comprising:

a clamping ring to couple the screed guide to the drain base, the clamping ring comprising:

a number of clamping ring apertures defined in the clamping ring through which a number of fasteners are extended to couple the clamping ring to the drain base via the screed guide coupling apertures of the recessed circular center portion of the screed guide.

8. The system of claim 1, wherein the screed guide is made of an oxidation-proof metal.

9. The system of claim 1, wherein the screed guide is made of acrylonitrile butadiene styrene (ABS).

10. A screed guide drain adaptor, comprising:

a circular disk with a recessed circular center portion defined therein, the recessed circular center portion creating a transition between an outer ring portion and the recessed circular center portion;

a drain aperture defined within the recessed circular center portion, wherein the screed guide is made of a rigid material; and a texturing defined in at least a portion of the screed guide.

11. The screed guide adaptor of claim 10, wherein the screed guide coupling apertures defined in the recessed circular center portion are dimensioned to allow a number of fasteners to extend to couple a clamping ring to a drain base via the screed guide coupling apertures.

12. The screed guide adaptor of claim 10, wherein the transition is angled with respect to the outer ring and the recessed circular center portion and couples the outer ring to the recessed circular center portion.

13. The screed guide adaptor of claim 12, wherein the outer ring comprises a first slope relative to a horizontal line that enables drainage of fluid across the first slope.

14. The screed guide adaptor of claim 12, wherein the recessed circular center portion comprises a second slope relative to a horizontal line that enables drainage of the fluid across the second slope.

15. A kit for screeding a drain pour comprising:

a drain base to couple a drain to a clamping ring; and a screed guide to couple to the drain base between the drain base and the clamping ring, the screed guide comprising:

a circular disk with a recessed circular center portion defined therein, the recessed circular center portion creating a transition ring between an outer ring and the recessed circular center portion, wherein the screed guide is made of a rigid material, wherein the transition ring is angled with respect to the outer ring and the recessed circular center portion, and couples the outer ring to the recessed circular center portion, and wherein the outer ring of the screed guide comprises a first slope relative to a horizontal line that enables drainage of fluid across the first slope.

16. The kit of claim 15, further comprising:

the clamping ring, wherein the clamping ring comprises a threaded aperture defined within a center of the clamping ring; and an adjustable drain barrel comprising a threading formed on an exterior barrel portion of the drain barrel that mates with the threaded aperture of the clamping ring.

17. The kit of claim 15, wherein the recessed circular center portion of the screed guide comprises a second slope relative to a horizontal line that enables drainage of the fluid across the second slope.

* * * * *